US007200956B1

(12) United States Patent
Kotha et al.

(10) Patent No.: US 7,200,956 B1
(45) Date of Patent: Apr. 10, 2007

(54) MAGNETIC FLUID CUSHIONING DEVICE FOR A FOOTWEAR OR SHOE

(75) Inventors: Sanjay Kotha, Falls Church, VA (US); Tirumalai S. Sudarshan, Vienna, VA (US)

(73) Assignee: Materials Modification, Inc., Fairfax, VA (US)

( * ) Notice: Subject to any disclaimer, the term of this patent is extended or adjusted under 35 U.S.C. 154(b) by 0 days.

(21) Appl. No.: 10/624,519

(22) Filed: Jul. 23, 2003

(51) Int. Cl.
*A43B 13/20* (2006.01)

(52) U.S. Cl. ..... 36/29; 36/88; 36/1

(58) Field of Classification Search ..... 36/29, 36/1, 88
See application file for complete search history.

(56) References Cited

U.S. PATENT DOCUMENTS

| | | | |
|---|---|---|---|
| 3,047,507 | A | 7/1962 | Winslow |
| 3,127,528 | A | 3/1964 | Lary et al. |
| 3,287,677 | A | 11/1966 | Mohr |
| 3,488,531 | A | 1/1970 | Rosensweig |
| 3,927,329 | A | 12/1975 | Fawcett et al. |
| 3,937,839 | A | 2/1976 | Strike et al. |
| 4,064,409 | A | 12/1977 | Redman |
| 4,106,488 | A | 8/1978 | Gordon |
| 4,107,288 | A | 8/1978 | Oppenheim et al. |
| 4,183,156 | A | 1/1980 | Rudy |
| 4,219,945 | A | 9/1980 | Rudy |
| 4,267,234 | A | 5/1981 | Rembaum |
| 4,268,413 | A | 5/1981 | Dabisch |
| 4,303,636 | A | 12/1981 | Gordon |
| 4,321,020 | A | 3/1982 | Mittal |
| 4,323,056 | A | 4/1982 | Borrelli et al. |
| 4,340,626 | A | 7/1982 | Rudy |
| 4,342,157 | A | 8/1982 | Gilbert |
| 4,364,377 | A | 12/1982 | Smith |
| 4,443,430 | A | 4/1984 | Mattei et al. |
| 4,452,773 | A | 6/1984 | Molday |
| 4,454,234 | A | 6/1984 | Czerlinski |
| 4,472,890 | A | 9/1984 | Gilbert |
| 4,501,726 | A | 2/1985 | Schröder et al. |
| 4,545,368 | A | 10/1985 | Rand et al. |
| 4,554,088 | A | 11/1985 | Whitehead et al. |
| 4,574,782 | A | 3/1986 | Borrelli et al. |
| 4,613,304 | A | 9/1986 | Meyer |
| 4,628,037 | A | 12/1986 | Chagnon et al. |
| 4,637,394 | A | 1/1987 | Racz et al. |
| 4,662,359 | A | 5/1987 | Gordon |
| 4,672,040 | A | 6/1987 | Josephson |
| 4,695,392 | A | 9/1987 | Whitehead et al. |
| 4,695,393 | A | 9/1987 | Whitehead et al. |

(Continued)

FOREIGN PATENT DOCUMENTS

| | | |
|---|---|---|
| DE | 37 38 989 A1 | 5/1989 |

(Continued)

OTHER PUBLICATIONS

Azuma, Y. et al. "Coating of ferric oxide particles with silica by hydrolysis of TEOS", Journal of the Ceramic Society of Japan, 100(5), 646-51 (Abstract) (May 1992).

(Continued)

*Primary Examiner*—Marie Patterson
(74) *Attorney, Agent, or Firm*—Dinesh Agarwal, P.C.

(57) ABSTRACT

A cushioning device for a footwear or shoe includes a chamber with a magnetically responsive fluid therein for absorbing and/or dampening vibrations and/or shocks. A magnetic member, such as an electromagnet, is provided for applying a magnetic field to the magnetic fluid to thereby vary the viscosity thereof.

87 Claims, 5 Drawing Sheets

U.S. PATENT DOCUMENTS 4,721,618 A 1/1988 Giles et al.
4,951,675 A 8/1990 Groman et al.
4,992,190 A 2/1991 Shtarkman
4,999,188 A 3/1991 Solodovnik et al.
5,067,952 A 11/1991 Gudov et al.
5,069,216 A 12/1991 Groman et al.
5,079,786 A * 1/1992 Rojas ..... 5/654
5,108,359 A 4/1992 Granov et al.
5,161,776 A 11/1992 Nicholson
5,178,947 A 1/1993 Charmot et al.
5,180,583 A 1/1993 Hedner
5,202,352 A 4/1993 Okada et al.
5,207,675 A 5/1993 Canady
5,236,410 A 8/1993 Granov et al.
5,348,050 A 9/1994 Ashton
5,354,488 A 10/1994 Shtarkman et al.
5,358,659 A 10/1994 Ziolo
5,374,246 A 12/1994 Ray
5,427,767 A 6/1995 Kresse et al.
5,466,609 A 11/1995 Siiman et al.
5,493,792 A 2/1996 Bates et al.
5,507,744 A 4/1996 Tay et al.
5,525,249 A 6/1996 Kordonsky et al.
5,549,837 A 8/1996 Ginder et al.
5,565,215 A 10/1996 Gref et al.
5,582,425 A 12/1996 Skanberg et al.
5,595,735 A 1/1997 Saferstein et al.
5,597,531 A 1/1997 Liberti et al.
5,599,474 A * 2/1997 Weiss et al. ..... 252/62.52
5,624,685 A 4/1997 Takahashi et al.
5,635,162 A 6/1997 Fischer
5,635,215 A 6/1997 Boschetti et al.
5,645,849 A 7/1997 Pruss et al.
5,646,185 A 7/1997 Giaccia et al.
5,650,681 A 7/1997 DeLerno
5,667,715 A 9/1997 Foister
5,670,078 A 9/1997 Ziolo
5,673,721 A 10/1997 Alcocer
5,695,480 A 12/1997 Evans et al.
5,702,630 A 12/1997 Sasaki et al.
5,707,078 A 1/1998 Swanberg et al.
5,714,829 A 2/1998 Guruprasad
5,782,954 A 7/1998 Luk
5,800,372 A 9/1998 Bell et al.
5,813,142 A * 9/1998 Demon ..... 36/29
5,900,184 A 5/1999 Weiss et al.
5,919,490 A 7/1999 Zastrow et al.
5,927,753 A 7/1999 Faigle et al.
5,947,514 A 9/1999 Keller et al.
5,958,794 A 9/1999 Bruxvoort et al.
5,993,358 A * 11/1999 Gureghian et al. ..... 482/54
6,013,531 A 1/2000 Wang et al.
6,027,664 A 2/2000 Weiss et al.
6,036,226 A 3/2000 Brown et al.
6,036,955 A 3/2000 Thorpe et al.
6,039,347 A 3/2000 Maynard
6,044,866 A 4/2000 Rohrbeck
6,051,607 A 4/2000 Greff
6,076,852 A 6/2000 Faigle
6,083,680 A 7/2000 Ito et al.
6,096,021 A 8/2000 Helm et al.
6,136,428 A 10/2000 Truong et al.
6,149,576 A 11/2000 Gray et al.
6,149,832 A 11/2000 Foister
6,167,313 A 12/2000 Gray et al.
6,186,176 B1 2/2001 Gelbmann
6,189,538 B1 2/2001 Thorpe
6,225,705 B1 5/2001 Nakamats
6,266,897 B1 7/2001 Seydel et al.
6,274,121 B1 8/2001 Pilgrimm
6,299,619 B1 10/2001 Greene, Jr. et al.
6,312,484 B1 11/2001 Chou et al.
6,315,709 B1 11/2001 Garibaldi et al.
6,319,599 B1 * 11/2001 Buckley ..... 428/308.4
6,335,384 B1 1/2002 Evans et al.
6,355,275 B1 3/2002 Klein
6,358,196 B1 3/2002 Rayman
6,391,343 B1 5/2002 Yen
6,399,317 B1 6/2002 Weimer
6,409,851 B1 6/2002 Sethuram et al.
6,443,993 B1 * 9/2002 Koniuk ..... 623/24
6,468,730 B2 10/2002 Fujiwara et al.
6,475,710 B2 11/2002 Kudo et al.
6,481,357 B1 11/2002 Linder et al.
6,489,694 B1 12/2002 Chass
6,527,972 B1 * 3/2003 Fuchs et al. ..... 252/62.54
6,530,944 B2 3/2003 West et al.
6,548,264 B1 4/2003 Tan et al.
6,557,272 B2 * 5/2003 Pavone ..... 36/29
6,663,673 B2 * 12/2003 Christensen ..... 623/56
6,666,991 B1 12/2003 Atarashi et al.
6,683,333 B2 1/2004 Kazlas et al.
6,734,574 B2 5/2004 Shin
6,768,230 B2 7/2004 Cheung et al.
6,789,820 B2 9/2004 Meduvsky et al.
6,815,063 B1 11/2004 Mayes
6,871,871 B2 3/2005 Parizat et al.
2001/0011810 A1 8/2001 Saiguchi et al.
2001/0016210 A1 8/2001 Mathiowitz et al.
2001/0033384 A1 10/2001 Luo et al.
2002/0045045 A1 4/2002 Adams et al.
2002/0164474 A1 * 11/2002 Buckley ..... 428/308.4
2003/0009910 A1 * 1/2003 Pavone ..... 36/29
2003/0216815 A1 * 11/2003 Christensen ..... 623/37
2004/0002665 A1 * 1/2004 Parihar et al. ..... 600/587
2004/0051283 A1 3/2004 Parizat et al.
2004/0132562 A1 * 7/2004 Schwenger et al. ..... 473/546
2004/0154190 A1 * 8/2004 Munster ..... 36/28

FOREIGN PATENT DOCUMENTS

DE 10240530 * 3/2004

OTHER PUBLICATIONS

Atarashi, T. et al. "Synthesis of ethylene-glycol-based magnetic fluid using silica-coated iron particle", Journal of Magnetism and Magnetic Materials, 201, 7-10 (1999).
Homola, A. M. et al., "Novel Magnetic Dispersions Using Silica Stabilized Particles", IEEE Transactions on Magnetics, 22 (5), 716-719 (Sep. 1986).
Giri, A. et al. "AC Magnetic Properties of Compacted FeCo Nanocomposites", Mater. Phys. and Mechanics, 1, 1-10 (2000).
U.S. Appl. No. 10/157,921, filed May 31, 2002.
PCT Serial No. PCT/US03/14545, filed May 28, 2003.
U.S. Appl. No. 10/302,962, filed Nov. 25, 2002.
PCT Serial No. PCT/US03/16230, filed Jun. 25, 2003.
Lubbe, AS et al. "Clinical experiences with magnetic drug targeting: a phase I study with 4'-expidoxorubicin in 14 patients with advanced solid tumors", Cancer Research, vol. 56, Issue 20, 4686-4693 (Abstract) (1996).
Sako, M et al., "Embolotherapy of hepatomas using ferromagnetic microspheres, its clinical evaluation and the prospect of its use as a vehicle in chemoembolo-hyperthermic therapy", Gan to kagaku ryoho. Cancer & chemotherapy, vol. 13, No. 4, Pt. 2, 1618-1624 (Abstract) (1986).
Zahn, M. "Magnetic Fluid and Nanoparticle Applications to Nanotechnology", Journal of Nanoparticle Research 3, pp. 73-78, 2001.
Remington: The Science and Practice of Pharmacy, vol. II, pp. 1524-1528 (1995).

* cited by examiner

MAGNETIC FLUID CUSHIONING DEVICE FOR A FOOTWEAR OR SHOE

BACKGROUND OF THE INVENTION

The present invention is generally directed to footwear or shoes, and more particularly to a cushioning device for a footwear or shoe including a magnetic fluid for absorbing and dampening vibrations and shocks.

Magnetic fluids typically include magnetic field responsive fluids containing magnetizable particles dispersed in a liquid carrier. These fluids typically have been used in devices, such as dampers, shock absorbers, seals, valves and the like to provide varying stress levels controlled by an external magnetic field. The variable stress is created by magnetic coupling of the particles in the form of chains or bent wall-like structures upon interaction with an external magnetic field. As to the composition, these fluids are typically include micron-sized or nano-sized particles dispersed in an engineering medium, such as hydraulic oil, mineral oil, or water, or the like.

A shoe typically consists of two parts, an upper and a sole. The upper encloses the foot and the sole contacts the ground and provides the wearer with support and protection of the foot. The sole may contact the ground with considerable force, therefore, the sole must act as a shock absorber and consist of an energy absorbent material. Shock absorption on impact is considered to be one of the most important factors in foot and knee injuries sustained by runners and joggers. In addition, injuries are also sustained from activities such as basketball, volleyball, and aerobics due to both forefoot and rearfoot impacts.

The use of elastomeric foams, such as ethylene vinyl acetate (EVA) foam, gas chambers in a foam midsole, gel filled cushioning elements, and springs to absorb shock and support and cushion the foot, is well known in the art. In addition, prior art discloses shoe soles or inserts for the sole which contain a fluid medium designed to absorb shock and support and cushion the foot. The following are examples of various prior art.

U.S. Pat. Nos. 4,183,156, 4,219,945, and 4,340,626 disclose the use of resilient fluid bladders as midsole special cushioning elements.

U.S. Pat. Nos. 4,342,157 and 4,472,890 disclose liquid filled shock absorbing cushions in the heel portion and the forefoot portion of a shoe. The liquids include water, glycerine, mineral oil, or other suitable low viscosity liquids.

U.S. Pat. No. 5,493,792 discloses a shoe with a sole portion and at least one cushioning element including a chamber having flexible walls filled with a liquid composition. The liquid composition preferably includes an amount of gel having a gel density and an amount of particulate having a particulate density wherein the particulate density is less than the gel density. However, in this patent the particulate slows the movement of the gel between partitioned sections within the chamber. The particulate also takes on an aesthetic role as it may be viewed through the cushioning element as the cushioning element has transparent walls.

U.S. Pat. No. 6,266,897 discloses a ground contacting system including 3D deformation elements having interiors filled with a compressible fluid or other materials such as liquids, foams, viscous materials, and/or viscoelastic materials. The 3D deformation elements decrease the amount of force transferred to the wearer due to their ability to deform, distort, or deflect three dimensionally.

The conventional shoes are problematic in providing adequate support, comfort, and shock absorption. Therefore, there is a need in the industry for a cushioning device for a footwear or shoe which includes a magnetic fluid for absorbing and dampening vibrations and shocks.

OBJECTS AND SUMMARY OF THE INVENTION

The principal object of the present invention is to provide a cushioning device for a footwear or shoe which includes a magnetically responsive fluid, and a magnet member for applying a magnetic field to the fluid for varying the viscosity thereof. The fluid functions as a shock absorbing fluid, and has a relatively high viscosity. Preferably, the viscosity of the fluid, even when not acted upon by a magnetic field, is greater than the viscosity of water, glycerine, hydraulic oil, and/or mineral oil.

An object of the present invention is to provide a cushioning device for a footwear or shoe which includes a magnetically responsive fluid. The magnetically responsive fluid includes a particulate matter which gives the fluid magnetic and rheological properties so that the fluid may absorb and/or dampen shocks and/or vibrations upon the application of a magnetic field.

Another object of the present invention is to provide a cushioning device for a footwear or shoe which includes a magnetically responsive fluid. The magnetically responsive fluid remains substantially rigid in order to absorb and/or dampen shocks and/or vibrations.

Still yet another object of the present invention is to provide a cushioning device for a footwear or shoe sole which includes a weight sensor, a movement sensor, a control unit, an electromagnet, a lithium ion battery, and a magnetic fluid. The shoe sole includes at least one cavity filled with a magnetic fluid and an electromagnet. The electromagnet applies a magnetic field to the magnetic fluid such that the magnetic fluid absorbs and/or dampens shocks and/or vibrations before they are transferred to the wearer's foot.

An additional object of the present invention is to provide a cushioning device for a footwear or shoe sole which includes a magnetic fluid and a device capable of generating a magnetic field that will cushion the wearer's foot and provide comfort and support for the wearer.

Yet an additional object of the present invention is to provide a cushioning device for a footwear or shoe sole which includes a fluid that is magnetically responsive and exhibits rheological changes upon interaction with a magnetic field generated by a device capable of generating a magnetic field.

Still yet an additional object of the present invention is to provide a cushioning device for a footwear or shoe sole which includes a fluid that is magnetically responsive and exhibits rheological changes upon interaction with a magnetic field generated by at least one electromagnet.

In summary, the main object of the present invention is to provide a cushioning device for a footwear or shoe which uses a magnetically responsive fluid to absorb and/or dampen shocks and/or vibrations to cushion the wearer's foot thereby providing comfort and support for the wearer.

At least one of the above-noted objects is met, in part, by the present invention, which in one aspect includes a cushioning device for a footwear including a chamber with a magnetically responsive fluid, and a magnetic member for applying a magnetic field to the fluid thereby varying the viscosity thereof.

Another aspect of the present invention includes a sole for a footwear including a chamber with a magnetically responsive fluid, a magnetic member for applying a magnetic field to the fluid thereby varying the viscosity thereof, and a control unit for relaying a signal to the magnetic member to apply a magnetic field.

Another aspect of the present invention includes a sole for a footwear including a chamber with a magnetically responsive fluid, an electromagnet for applying a magnetic field to the fluid thereby varying the viscosity thereof, a movement sensor for determining the movement of a footwear, a weight sensor for determining the weight of a user of a footwear, and a control unit for receiving information from one of the movement and weight sensors and relaying a control signal to the electromagnet for applying a magnetic field.

Another aspect of the present invention includes a method of varying the shock absorbing capacity of a footwear cushioning device, including providing a cushioning device comprising a chamber including a magnetically responsive fluid, and a magnetic member for applying a magnetic field to the fluid, applying a magnetic field to the fluid based on an input to thereby vary the viscosity of the fluid, and whereby a change in viscosity of the magnetic fluid changes the shock absorbing capacity of the cushioning device.

BRIEF DESCRIPTION OF THE DRAWINGS

The above and other objects, novel features and advantages of the present invention will become apparent from the following detailed description of the preferred embodiment(s) of the invention, as illustrated in the drawings, in which.

DETAILED DESCRIPTION OF THE PREFERRED EMBODIMENT(S) OF THE INVENTION

It is noted initially that the term "shoe", as used herein, broadly includes all types of footwear including, for example, slippers, sandals, and casual, sports and dress shoes.

Figure 1:
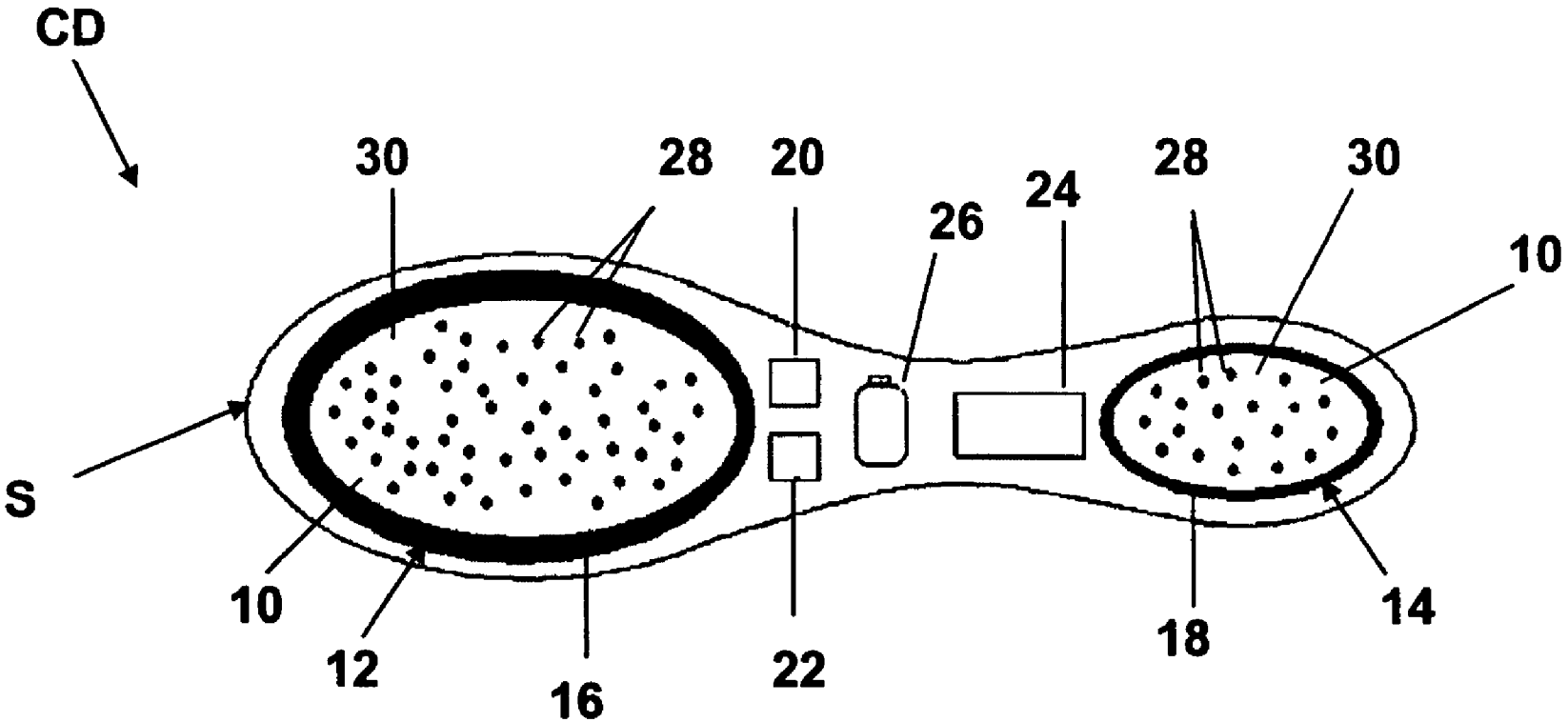
FIG. 1 is a schematic illustration of a footwear sole incorporating a cushioning device in accordance with the present invention.

FIG. 1 illustrates a cushioning device CD incorporated in a footwear sole S. As shown, the cushioning device CD includes a magnetic fluid 10 incorporated in a toe cavity 12 (and/or a heel cavity 14). The toe and heel cavities 12 and 14 include magnetic elements, such as electromagnets 16 and 18, respectively. Preferably, the electromagnet 16 (and/or electromagnet 18) extends above and below the toe cavity 12 (and/or heel cavity 14) (FIG. 2), as one integral piece, but may alternatively be provided as two separate members. (It is noted herewith that while both toe and heel cavities 12 and 14 are illustrated herein to contain the magnetic fluid 10, only one is necessary for the cushioning device CD of the present invention.)

The cushioning device CD further includes a weight sensor 20, a movement sensor 22, a control unit 24, and a source of electrical power, such as a lithium ion battery 26. The magnetic fluid 10 includes magnetic particles 28 dispersed in a carrier fluid 30.

The weight sensor 20 detects the weight of a wearer and determines the force the wearer exerts upon the ground, while the movement sensor 22 detects the wearer's movement. The movement sensor 22 can distinguish between various types of movement or activities, such as running, jogging, jumping, stepping, skipping, brisk walking, slow walking, etc. The data from the weight sensor 20 and the movement sensor 22 is transmitted to the control unit 24, which combines the data to determine an appropriate resistive force and the amount and direction of the magnetic field necessary to generate that resistive force in the magnetic fluid 10.

The control unit 24 relays a time varying current signal to the electromagnet 16 (and/or 18), which generates the amount of magnetic field in a particular direction (preferably generally vertically relative to a generally horizontal support surface) necessary for the magnetic fluid 10 to generate the appropriate resistive force. A stronger magnetic field gives a greater resistive force, while a weaker magnetic field gives a weaker resistive force. The resistive force generated by magnetic fluids in the presence of an applied magnetic field has been thoroughly investigated and are observed to be dependent upon the magnetic susceptibility, applied field strength, saturation magnetism and the particle volume. Dipolar interactions between the particles causes them to align into chains with a coupling constant $\lambda$ defined by the following equation:

$$\lambda = f(\mu, a3, H, \chi)$$

where $\mu$ is the magnetic permeability, a is the particle radius, H is the magnetic field strength, and $\chi$ is the particle susceptibility. The higher is the particle susceptibility, faster is the response time to varying magnetic field. Depending upon the sample confinement, the rate of applied magnetic field and the particle concentration, the particles coalesce together to form either separated columns or chains, or 'bent-wall' like structures. These field-induced structures give rise to an anisotropic rheological response exhibiting an increase in viscosity normal to the direction of the applied field with certain resistive force. With respect to direction, a magnetic field applied in a direction such that chains of magnetic particles are formed generally perpendicular to a horizontally oriented ground gives a greater resistive force than a magnetic field applied in a direction that causes chains of magnetic particles to form parallel to a horizontally oriented ground. Upon application of a magnetic field by the electromagnet 16 (and/or 18), the particles 28 within the magnetic fluid 10 magnetically couple to form preferably generally vertically oriented, generally rectilinear chains and/or bent-wall like structures 32 and 34 (FIGS. 3 and 4), which creates a yield stress. Therefore, upon application of a magnetic field by the electromagnet 16 (and/or 18), the magnetic fluid 10 becomes more resistive and capable of absorbing shocks and/or vibrations.

Figure 2:
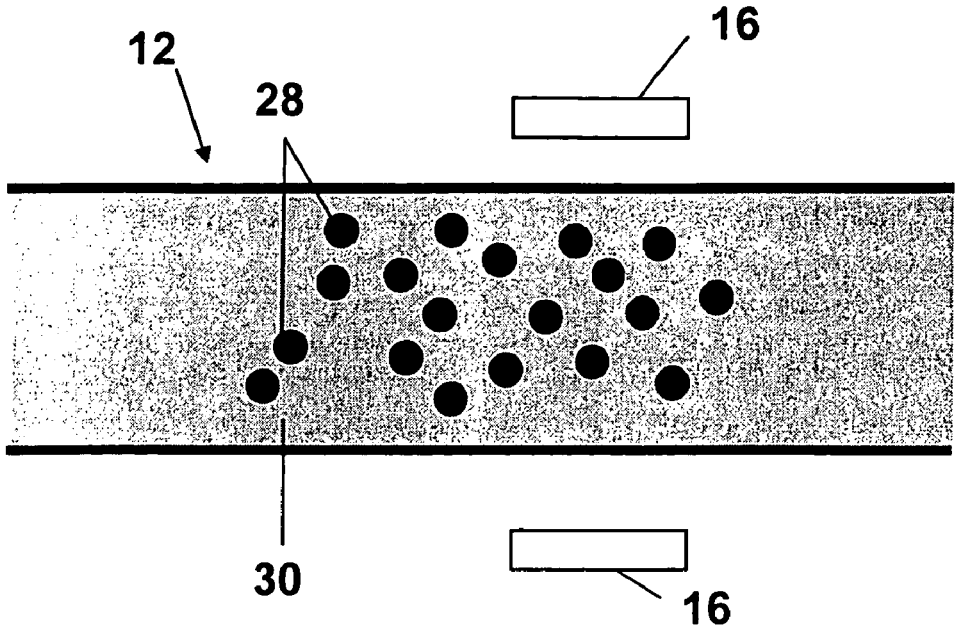
FIG. 2 is a schematic illustration of a partial, enlarged portion of the toe cavity showing the conformation of the magnetic particles in the fluid not exposed to a magnetic field.

If the control unit 24 determines from the weight and movement data that no resistive force is necessary, the control unit 24 relays a time varying current signal to the electromagnet 16 (and/or 18) indicating that no magnetic field is necessary. For example, when a person is not wearing the shoe, there is zero weight and zero movement, and the magnetic field remains in the off position. (However, when a load is put on the shoe and a movement is detected by the movement sensor 22, the magnetic field is triggered to provide an optimal resistive force.) As illustrated in FIG. 2, the electromagnet 16 (and/or 18) does not generate a magnetic field and the magnetic particles 28 within the magnetic fluid 10 remain freely suspended.

Figure 3:
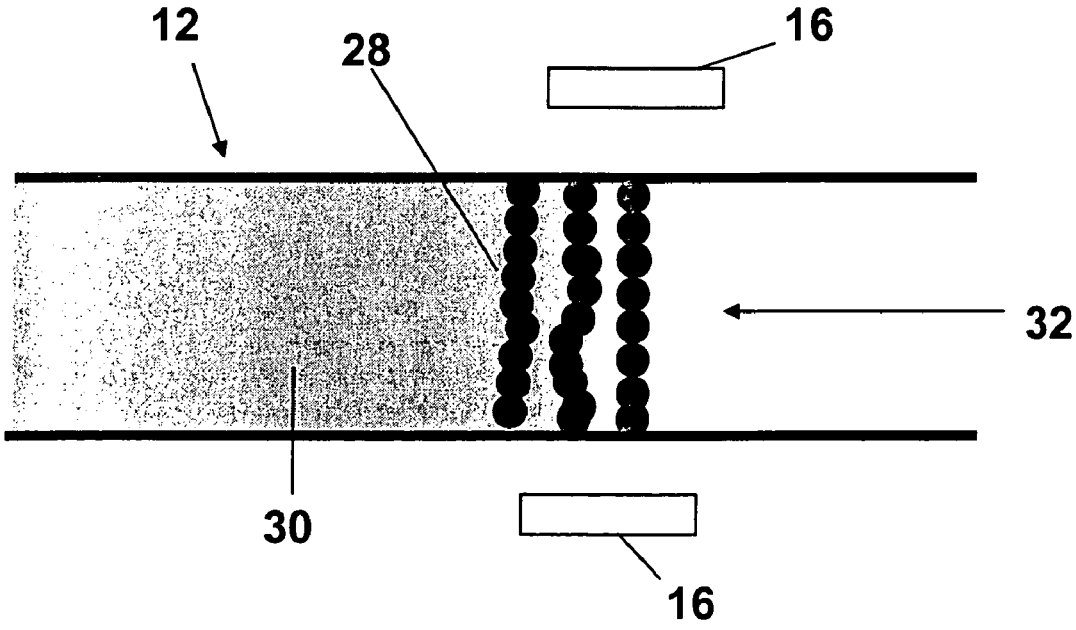
FIG. 3 is a view similar to FIG. 2, showing the conformation of the magnetic particles in the fluid exposed to a strong magnetic field.

If the control unit 24 determines from the weight and movement data that a maximum resistive force is necessary, the control unit 24 relays a time varying current signal to the electromagnet 16 (and/or 18) indicating that a maximum magnetic field is necessary. As illustrated in FIG. 3, the electromagnet 16 (and/or 18) generates a maximum magnetic field and the magnetic particles 28 within the magnetic fluid 10 magnetically couple to form generally straight chains and/or bent-wall like structures 32.

Figure 4:
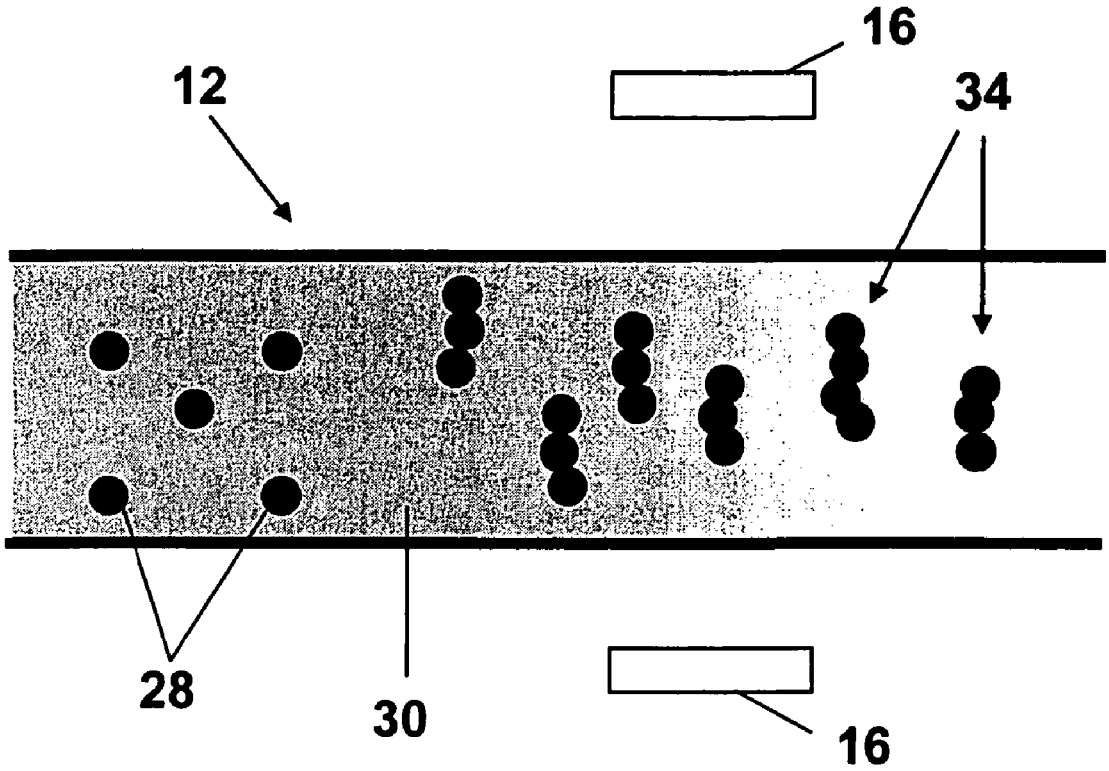
FIG. 4 is a view similar to FIG. 2, showing the conformation of the magnetic particles in the fluid exposed to an intermediate magnetic field.

If the control unit 24 determines from the weight and movement data that an intermediate resistive force is necessary, the control unit 24 relays a time varying current signal to the electromagnet 16 (and/or 18) indicating that an intermediate magnetic field is necessary. As illustrated in FIG. 4, the electromagnet 16 (and/or 18) generates an intermediate magnetic field and some of the magnetic particles 28 within the magnetic fluid 10 remain freely suspended, while the other magnetic particles 28 within the magnetic fluid 10 magnetically couple to form shorter chains or bent wall-like structures 34.

In addition to varying the strengths of a magnetic field applied by the electromagnet 16 (and/or 18), the control unit 24 also has the capacity to relay signals to electromagnets 16 and 18 individually, substantially simultaneously, or at different times. This feature becomes important and desirable when one movement/activity over another is selected by the wearer. For instance, if the footwear is being used in running or jogging, it may be desirable to have an increased resistive force in the heel area, as opposed to the toe area. Likewise, it may be desirable to have the same level of resistive force in both the heel and toe areas, in the event a footwear is used for casual walking. The control unit 24 may therefore be programmed to relay appropriate signals to one or both electromagnets 16 and 18, as desired.

Preferably, the movement sensor 22 is also capable of detecting surface conditions, and the control unit 24 incorporates the surface condition data with the weight and movement data when determining the necessary resistive force.

The sensors 20 and 22, control unit 24, and the electromagnet 16 (and/or 18) are powered by a source of electrical power, such as the rechargeable Li-ion battery 26. Rechargeable Li-ion battery 26 is the preferred power source as it is compact, lightweight, and has a high power density. It produces power for approximately two days until it needs recharging depending upon the wearer's level of activity.

It is noted herewith that the resistive force generated by the formation of chain or bent-wall like structures in the magnetic fluid 10, is reversible, and not permanent. The force preferably lasts only as long as the magnetic field is present. Once the magnetic field is removed or is no longer present, the magnetic particles decouple and become freely suspended again in the magnetic fluid 10.

The particles 28 in the magnetic fluid 10 may be synthesized by various methods, such as chemical synthesis, sol-gel, chemical co-precipitation and microwave plasma technique. The microwave plasma technique, described in U.S. Pat. No. 6,409,851 by Sethuram et al. (incorporated herein in its entirety by reference) is the preferred technique as it is unique in that it gives better control over particle size, shape and purity, and can be readily extended to produce different compositions of powders. The magnetic fluid 10 includes a carrier medium 30 and a particulate material comprised of particles 28. The particulate material is preferably made of iron, iron oxide, cobalt, cobalt oxide, nickel, nickel oxide, an alloy such as steel, or a combination thereof. Preferably, the particulate material is made of iron, iron oxide, or a combination thereof.

The average diameter or size of the particles can be from about 1 nm to 100 μm. The preferred size is about 1 nm to 10 μm, while the most preferred size is about 10 nm to 5 μm. The size of the particles partially determines the magnetic character of the magnetic fluid and the maximum yield stress attainable. Larger particles give the magnetic fluid a greater magnetic character and a larger maximum yield stress, while smaller particles give the magnetic fluid a smaller magnetic character and a smaller maximum yield stress. A particle mixture of more than one particle size may be used to obtain a desired magnetic response.

Figure 6:
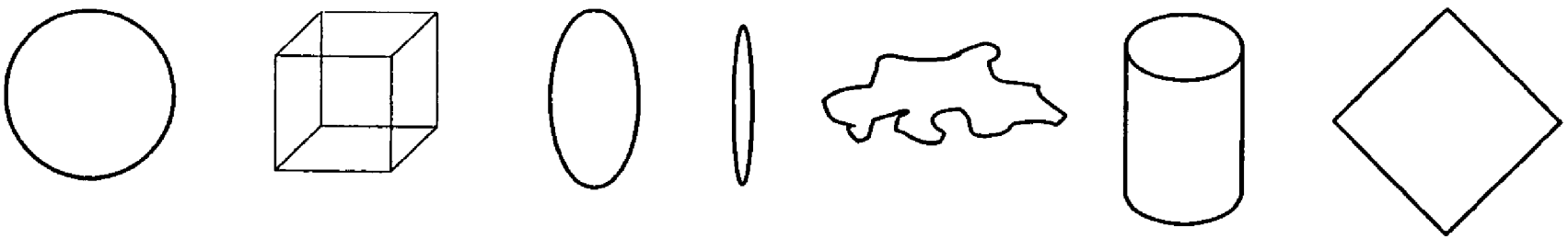
FIG. 6 illustrates various shapes of the magnetic particles for use in the present invention.

The shape of the particles is important for two reasons. First, the magnetic effect is dependent upon the particle volume fraction, which in turn is a function of the particle shape. For instance, needle-shaped particles exhibit similar magnetic effect at concentrations ten times smaller than spherical particles because of larger surface area per volume. Second, the flow characteristics of the particles in a liquid medium are dependent upon their shape. The shapes utilized in this invention include, but are not limited to, spherical, needle-like, cubic, irregular, cylindrical, diamond, oval, or a combination thereof (FIG. 6).

Preferably, the particulate volume or weight fraction is about 1–95%. A greater particulate volume or weight fraction results in an enhanced magnetic character and a greater maximum yield stress. However, if the particulate volume or weight fraction is too large, the zero field viscosity is too great and the magnetic fluid loses fluidity when no magnetic field is applied. The term zero field viscosity refers to the viscosity of the magnetic fluid when no magnetic field acts upon the magnetic fluid.

In the present invention, the surface coating on the particles serves several purposes, including preventing particle agglomeration and preventing dissolution of the magnetic materials.

Colloidal particles have an inherent tendency to aggregate and form clusters or agglomerate due to attractive van der Waals (vdW) forces. To stabilize the particles against these attractive forces, it is necessary to introduce a repulsive interparticle force, either by an electrostatic or by a steric means. Electrostatic stabilization utilizes the surface charge typically present on the particles, which is effective in a medium having a high dielectric constant, such as water, while in steric stabilization, a sufficiently thick layer of a polymeric or surfactant molecules is introduced around the particles. The surface layer functions as a steric barrier to prevent particle agglomeration, and thereby ensures stability of the fluid. The surface layer also prevents dissolution of the magnetic materials. This technique is preferred for the present invention. The particles are preferably coated with a surfactant and/or coating by adsorption of surfactant and/or coating molecules onto the particles in the presence of ultrasonic irradiation in a high shear field. The types of surfactants that may be utilized in the present invention include, but are not limited to, polyethylene glycol, lecithin, oleic acid, or Surfynol® surfactants (available from Air Products). The types of coatings that may be utilized in the present invention include, but are not limited to, silica, gold, silver, platinum, steel, cobalt, carbon, a polymer, or a combination thereof. The polymer can be one of polyethylene glycol, polystyrene, dextran, or a combination thereof. Preferably, the particles are only coated with lecithin or Surfynol® surfactants (available from Air Products).

The magnetic particles coated with a surfactant are dispersed in a carrier liquid by high shear mixing followed by ultrasonification to form a homogenous fluid. The carrier liquid helps to retain the fluidity of the magnetic fluid when the magnetic fluid is not acted upon by a magnetic field. It is also important as it partially determines the effective fluid viscosity. Carrier liquids are preferably water based and oil based liquids, such as glycerol/water, and/or mineral oil mixtures. Preferably, the carrier liquid is water, hydraulic oil, mineral oil, silicone oil, biodegradable oils, or a combination thereof.

EXAMPLE

Ultrafine powders of iron oxide with an average particle size of about 45–50 nm were produced using the proprietary microwave plasma chemical synthesis process described in U.S. Pat. No. 6,409,851 by Sethuram et al. Vapors of iron pentacarbonyl were fed into the plasmatron with argon/oxygen as the plasma gas. The plasma gas flow rate was about 0.003–0.0034 $m^3$/min and that of the carrier gas was about 0.0003–0.0004 $m^3$/min. The plasma temperature was about 900–950° C., the powder feed rate was about 50–60 gm/hr, and the quenching water flow rate was about 2.0–2.5 liter/min at about 20° C. The reactor column diameter was about 48 mm and its length was about 10". The microwave forward power was about 4 kW, the reflected power was about 0.7 kW, and the operating frequency was about 2450 MHZ.

Standard magnetic characterization of temperature dependent susceptibility and M-H hysteresis loops were performed using a variable temperature range of about 5 K to 350 K and magnetic fields of about 0 T–5 T. The magnetic characterization tests were performed using Magnetic Property Measurement Systems from Quantum Design that uses SQUID magnetometry. The coercivity of the iron oxide nanopowders was about 176 Oe and the magnetic saturation was about 40 emu/g.

Lecithin (about 2 wt %—optimized) was mixed in Mobil DTE 20 series hydraulic oil using a high speed emulsifier at speeds close to 11,000 rpm. The iron oxide nanopowders were added the oil and the mixing continued. The mixing speed was kept constant at about 11,000 rpm for a mixing time of about 30 minutes. The solids loading was about 60 wt %.

Figure 5:
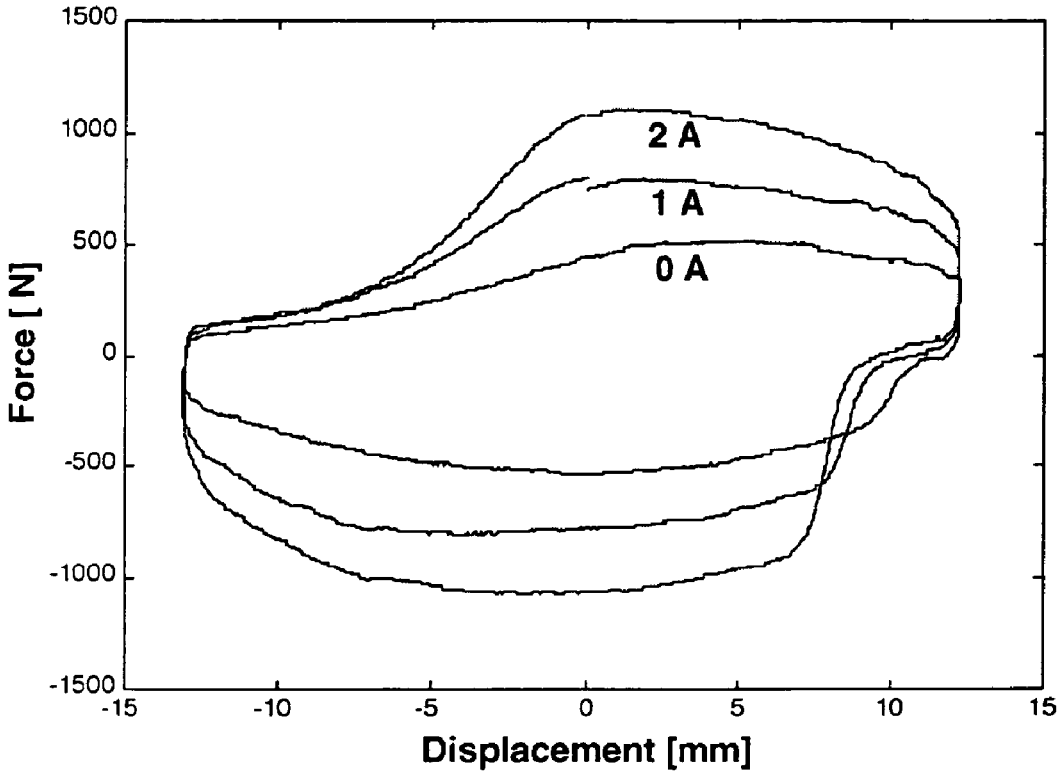
FIG. 5 shows force versus displacement hysteresis cycles at 0–2 A for magnetic fluid with 60% solids loading of iron oxide nanoparticles with an average diameter between 45–50 nm, lecithin as the surfactant, and Mobil DTE 20 series hydraulic oil as the carrier liquid.

Force versus displacement hysteresis cycles at 0–2 A were generated using an unpressurized Rheonetics truck seat damper (available from Lord Corporation, Cary, N.C.). The force versus displacement hysteresis cycles are shown in FIG. 5.

While this invention has been described as having preferred sequences, ranges, steps, materials, features, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. A cushioning device for a footwear, comprising:
a) a chamber including a magnetically responsive fluid;
b) said fluid comprising core particles of a magnetic material;
c) said core particles comprising first and second successive coatings;
d) one of said first and second coatings comprising a coating of at least one member selected from the group consisting of a ceramic material, a metallic material, and a combination thereof; and
e) a magnetic member for applying a magnetic field to said fluid thereby varying the viscosity thereof.

2. The cushioning device of claim 1, wherein:
a) the viscosity of said fluid is greater than the viscosity of at least one member selected from the group consisting of water, glycerine, hydraulic oil, mineral oil, and a combination thereof.

3. The cushioning device of claim 1, further comprising:
a) a weight sensor for determining the weight of a user of a footwear.

4. The cushioning device of claim 1, further comprising:
a) a movement sensor for determining the movement of a footwear.

5. The cushioning device of claim 3, further comprising:
a) a control unit for receiving information from said weight sensor and relaying a signal to said magnetic member to apply a magnetic field.

6. The cushioning device of claim 1, wherein:
a) a plurality of said core particles are attracted to form a magnetically connected structure when a magnetic field is applied to said fluid.

7. The cushioning device of claim 6, wherein:
a) said structure comprises generally rectilinear or bent configuration.

8. The cushioning device of claim 1, wherein:
a) said core particles have an average diameter of about 1 nm to 100 μm.

9. The cushioning device of claim 8, wherein:
a) said core particles have an average diameter of about 1 nm to 10 μm.

10. The cushioning device of claim 9, wherein:
a) said core particles have an average diameter of about 10 nm to 5 μm.

11. The cushioning device of claim 1, wherein:
a) said magnetic material comprises at least one member selected from the group consisting of iron, iron oxide, cobalt, cobalt oxide, nickel, nickel oxide, an alloy, and a combination thereof.

12. The cushioning device of claim 1, wherein:
a) the other of said first and second coatings comprises a coating of a surfactant.

13. The cushioning device of claim 12, wherein:
a) said surfactant comprises at least one member selected from the group consisting of lecithin, oleic acid, nonionic acetylenic diol, and a combination thereof.

14. The cushioning device of claim 1, wherein:
a) the member is selected from the group consisting of silica, gold, silver, platinum, steel, cobalt, carbon, dextran, and a combination thereof.

15. The cushioning device of claim 1, wherein:
a) said first coating comprises a coating of a surfactant; and
b) said second coating comprises a coating of the member.
16. The cushioning device of claim 15, wherein:
a) said surfactant comprises at least one member selected from the group consisting of lecithin, oleic acid, non-ionic acetylenic diol, and a combination thereof.
17. The cushioning device of claim 16, wherein:
a) said second coating comprises at least one member selected from the group consisting of silica, gold, silver, platinum, steel, cobalt, carbon, dextran, and a combination thereof.
18. The cushioning device of claim 8, wherein:
a) the other of said first and second coatings comprises a coating of a surfactant; and
b) said core particles are dispersed in a carrier fluid.
19. The cushioning device of claim 18, wherein:
a) said carrier fluid comprises a water-based or an oil-based carrier fluid.
20. The cushioning device of claim 18, wherein:
a) said carrier fluid comprises at least one member selected from the group consisting of water, hydraulic oil, mineral oil, silicone oil, biodegradable oil, and a combination thereof.
21. The cushioning device of claim 18, wherein:
a) said fluid comprises about 1–95% of said core particles.
22. The cushioning device of claim 8, wherein:
a) said core particles comprise at least one general shape selected from the group consisting of spherical, needle-shaped, cubic, irregular, cylindrical, diamond, oval, and a combination thereof.
23. A sole for a footwear, comprising:
a) a chamber including a magnetically responsive fluid;
b) said fluid comprising core particles of a magnetic material;
c) said core particles comprising first and second successive coatings;
d) one of said first and second coatings comprising a coating of at least one member selected from the group consisting of a ceramic material, a metallic material, and a combination thereof;
e) a magnetic member for applying a magnetic field to said fluid thereby varying the viscosity thereof; and
f) a control unit for relaying a signal to said magnetic member to apply a magnetic field.
24. The sole of claim 23, wherein:
a) the viscosity of said fluid is greater that the viscosity of at least one member selected from the group consisting of water, glycerine, hydraulic oil, mineral oil, and a combination thereof.
25. The sole of claim 23, further comprising:
a) a weight sensor for determining the weight of a user of a footwear.
26. The sole of claim 23, further comprising:
a) a movement sensor for determining the movement of a footwear.
27. The sole of claim 25, wherein:
a) said control unit receives information from said weight sensor for relaying a signal to said magnetic member to apply a magnetic field.
28. The sole of claim 27, wherein:
a) the strength of a magnetic field applied by said magnetic member is proportional to the weight of a user.
29. The sole of claim 23, wherein:
a) a plurality of said core particles form a magnetically connected structure when a magnetic field is applied to said fluid.
30. The sole of claim 29, wherein:
a) said structure comprises a generally rectilinear or bent configuration.
31. The sole of claim 30, wherein:
a) said structure is oriented in a generally vertical direction.
32. The sole of claim 23, wherein:
a) the sole comprises toe and heel portions each including one said chamber.
33. The sole of claim 32, wherein:
a) each of said toe and heel portions includes one said magnetic member.
34. The sole of claim 33, wherein:
a) the strengths of the magnetic fields applied by the magnetic members of said toe and heel portions may be substantially the same or different.
35. The sole of claim 33, wherein:
a) the magnetic members of said toe and heel portions apply magnetic fields substantially simultaneously or at different times.
36. The sole of claim 23, wherein:
a) said core particles have an average diameter of about 1 nm to 100 μm.
37. The sole of claim 36, wherein:
a) said core particles have an average diameter of about 1 nm to 10 μm.
38. The sole of claim 37, wherein:
a) said core particles have an average diameter of about 10 nm to 5 μm.
39. The sole of claim 23, wherein:
a) said magnetic material comprises at least one member selected from the group consisting of iron, iron oxide, cobalt, cobalt oxide, nickel, nickel oxide, an alloy, and a combination thereof.
40. The sole of claim 23, wherein:
a) the other of said first and second coatings comprises a coating of a surfactant.
41. The sole of claim 40, wherein:
a) said surfactant comprises at least one member selected from the group consisting of lecithin, oleic acid, non-ionic acetylenic diol, and a combination thereof.
42. The sole of claim 23, wherein:
a) the member is selected from the group consisting of silica, gold, silver, platinum, steel, cobalt, carbon, dextran, and a combination thereof.
43. The sole of claim 23, wherein:
a) said first coating comprises a coating of a surfactant; and
b) said second coating comprises a coating of the member.
44. The sole of claim 43, wherein:
a) said surfactant comprises at least one member selected from the group consisting of lecithin, oleic acid, non-ionic acetylenic diol, and a combination thereof.
45. The sole of claim 44, wherein:
a) said second coating comprises at least one member selected from the group consisting of silica, gold, silver, platinum, steel, cobalt, carbon, dextran, and a combination thereof.
46. The sole of claim 36, wherein:
a) the other of said first and second coatings comprises a coating of a surfactant; and
b) said core particles are dispersed in a carrier fluid.

47. The sole of claim 46, wherein:
a) said carrier fluid comprises a water-based or an oil-based carrier fluid.
48. The sole of claim 46, wherein:
a) said carrier fluid comprises at least one member selected from the group consisting of water, hydraulic oil, mineral oil, silicone oil, biodegradable oil, and a combination thereof.
49. The sole of claim 46, wherein:
a) said fluid comprises about 1–95% of said core particles.
50. The sole of claim 36, wherein:
a) said core particles comprise at least one general shape selected from the group consisting of spherical, needle-shaped, cubic, irregular, cylindrical, diamond, oval, and a combination thereof.
51. A sole for a footwear, comprising:
a) a chamber including a magnetically responsive fluid;
b) said fluid comprising core particles of a magnetic material;
c) said core particles comprising first and second successive coatings;
d) one of said first and second coatings comprising a coating of at least one member selected from the group consisting of a ceramic material, a metallic material, and a combination thereof;
e) an electromagnet for applying a magnetic field to said fluid thereby varying the viscosity thereof;
f) a movement sensor for determining the movement of a footwear;
g) a weight sensor for determining the weight of a user of a footwear; and
h) a control unit for receiving information from one of said movement and weight sensors and relaying a signal to said electromagnet for applying a magnetic field.
52. The sole of claim 51, wherein:
a) the viscosity of said fluid is greater than the viscosity of at least one member selected from the group consisting of water, glycerine, hydraulic oil, mineral oil, and a combination thereof.
53. The sole of claim 51, wherein:
a) the strength of a magnetic field applied by said magnetic member is proportional to the weight of a user.
54. The sole of claim 51, wherein:
a) a plurality of said core particles form a magnetically connected structure when a magnetic field is applied to said fluid.
55. The sole of claim 54, wherein:
a) said structure comprises a generally rectilinear or bent configuration.
56. The sole of claim 55, wherein:
a) said structure is oriented in a generally vertical direction.
57. The sole of claim 51, wherein:
a) the sole comprises toe and heel portions each including one said chamber.
58. The sole of claim 57, wherein:
a) each of said toe and heel portions includes one said magnetic member.
59. The sole of claim 58, wherein:
a) the strengths of the magnetic fields applied by the magnetic members of said toe and heel portions may be substantially the same or different.
60. The sole of claim 58, wherein:
a) the magnetic members of said toe and heel portions apply magnetic fields substantially simultaneously or at different times.
61. The sole of claim 51, wherein:
a) said core particles have an average diameter of about 1 nm to 100 μm.
62. The sole of claim 61, wherein:
a) said core particles have an average diameter of about 1 nm to 10 μm.
63. The sole of claim 62, wherein:
a) said core particles have an average diameter of about 10 nm to 5 μm.
64. The sole of claim 51, wherein:
a) said magnetic material comprises at least one member selected from the group consisting of iron, iron oxide, cobalt, cobalt oxide, nickel, nickel oxide, an alloy, and a combination thereof.
65. The sole of claim 51, wherein:
a) the other of said first and second coatings comprises a coating of a surfactant.
66. The sole of claim 65, wherein:
a) said surfactant comprises at least one member selected from the group consisting of lecithin, oleic acid, non-ionic acetylenic diol, and a combination thereof.
67. The sole of claim 59, wherein:
a) the member is selected from the group consisting of silica, gold, silver, platinum, steel, cobalt, carbon, polystyrene, dextran, and a combination thereof.
68. The sole of claim 51, wherein:
a) said first coating comprises a coating of a surfactant; and
b) said second coating comprises a coating of the member.
69. The sole of claim 68, wherein:
a) said surfactant comprises at least one member selected from the group consisting of lecithin, oleic acid, non-ionic acetylenic diol, and a combination thereof.
70. The sole of claim 69, wherein:
a) said second coating comprises at least one member selected from the group consisting of silica, gold, silver, platinum, steel, cobalt, carbon, dextran, and a combination thereof.
71. The sole of claim 61, wherein:
a) the other of said first and second coatings comprises a coating of a surfactant; and
b) said core particles are dispersed in a carrier fluid.
72. The sole of claim 71, wherein:
a) said carrier fluid comprises a water-based or an oil-based carrier fluid.
73. The sole of claim 71, wherein:
a) said carrier fluid comprises at least one member selected from the group consisting of water, hydraulic oil, mineral oil, silicone oil, biodegradable oil, and a combination thereof.
74. The sole of claim 71, wherein:
a) said fluid comprises about 1–95% of said core particles.
75. The sole of claim 61, wherein:
a) said core particles comprise at least one general shape selected from the group consisting of spherical, needle-shaped, cubic, irregular, cylindrical, diamond, oval, and a combination thereof.
76. The sole of claim 51, wherein:
a) said control unit receives information from said movement sensor for relaying a signal to said electromagnet to apply a magnetic field.
77. The sole of claim 76, wherein:
a) the strength of a magnetic field applied by said electromagnet depends on a type of movement detected by said movement sensor.

78. The sole of claim 77, wherein:

a) the type of movement is selected from the group consisting of walking, brisk walking, jogging, running, jumping, stepping, and skipping.

79. The sole of claim 51, wherein:

a) said control unit receives information from both of said movement and weight sensors.

80. The sole of claim 51, wherein:

a) the strength of a magnetic field applied by said electromagnet depends on a type of movement detected by said movement sensor.

81. The sole of claim 80, wherein:

a) the type of movement is selected from the group consisting of walking, brisk walking, jogging, running, jumping, stepping, and skipping.

82. The cushioning device of claim 8, wherein:

a) said core particles comprise a plurality of groups of particles having different average diameters.

83. The sole of claim 36, wherein:

a) said core particles comprise a plurality of groups of particles having different average diameters.

84. The sole of claim 61, wherein:

a) said core particles comprise a plurality of groups of particles having different average diameters.

85. A method of varying the shock absorbing capacity of a footwear cushioning device, comprising:

a) providing a cushioning device, comprising:

i. a chamber including a magnetically responsive fluid;

ii the fluid comprising core particles of a magnetic material;

iii) the particles comprising first and second successive coatings;

iv) one of said first and second coatings comprising a coating of at least one member selected from the group consisting of a ceramic material, a metallic material, and a combination thereof; and v) a magnetic member for applying a magnetic field to the fluid;

b) applying a magnetic field to the fluid based on an input to thereby vary the viscosity of the fluid; and c) whereby a change in viscosity of the magnetic fluid changes the shock absorbing capacity of the cushioning device.

86. The method of claim 85, wherein:

the input in step b) comprises weight data for a user received from a weight sensor.

87. The method of claim 85, wherein:

the input in step b) comprises movement data for a footwear received from a movement sensor.

* * * * *